United States Patent [19]

Wright

[11] Patent Number: 4,530,659

[45] Date of Patent: Jul. 23, 1985

[54] TEMPERATURE MEASUREMENT TECHNIQUE

[75] Inventor: Kenton B. Wright, Newburgh, Ind.

[73] Assignee: Aluminum Company of America, Pittsburgh, Pa.

[21] Appl. No.: 566,521

[22] Filed: Dec. 29, 1983

[51] Int. Cl.[3] ..... F27D 21/00; F27B 7/00

[52] U.S. Cl. ..... 432/32; 374/160; 432/192

[58] Field of Search ..... 374/160; 432/24, 32, 432/192

[56] References Cited

U.S. PATENT DOCUMENTS

| | | | |
|---|---|---|---|
| 1,788,794 | 1/1931 | Harris | 374/160 |
| 3,513,705 | 5/1970 | Severin | 374/160 |
| 3,704,985 | 12/1972 | Pickett et al. | 374/160 |
| 4,006,414 | 2/1977 | Parker | 324/106 |
| 4,050,880 | 9/1977 | Naito et al. | 432/192 |
| 4,354,828 | 10/1982 | Benton et al. | 432/24 |

*Primary Examiner*—John J. Camby

*Attorney, Agent, or Firm*—Daniel A. Sullivan, Jr.

[57] ABSTRACT

A method of determining the penetration of an isotherm into a mass, including the steps of distributing material in the mass, the material having the ability to fix a record of an isotherm, cycling the temperature of the mass, and checking the material for the location of the isotherm relative to the mass.

16 Claims, 2 Drawing Figures

TEMPERATURE MEASUREMENT TECHNIQUE

SUMMARY OF THE INVENTION

It is an object of the invention to provide a method for determining the penetration of an isotherm into a mass.

This as well as other objects which will become apparent in the discussion that follows are achieved by a method including distributing material in the mass, the material having the ability to fix a record of an isotherm, cycling the temperature of the mass, and checking the material for the location of the isotherm relative to the mass.

DESCRIPTION OF THE PREFERRED EMBODIMENTS

Maps can be made according to the present invention for specific isotherms at the time of maximum heat penetration during the extended firing cycles encountered in the baking of carbon anodes for smelting of aluminum.

This technique permits easily and accurately determining the locations within an anode load (car (tunnel kiln) or pit section (ring furnace)) reached by specific isotherms at the time of maximum penetration. For example, three particular isotherms are measurable. These are 1080° C., 1107° C., and 1160° C. (The 1080° C. isotherm, based on the melting point of copper, is the most reliable.) Maps outlining the isotherm area result.

U.S. Pat. No. 3,009,863 illustrates the use of cars (numeral 20 in FIG. 2 of that patent) for transporting an anode load through a tunnel kiln for baking the green carbon anodes into the so-called "prebaked" anodes used in producing aluminum by electrolysis of alumina dissolved in a molten cryolite-based bath.

Another example of tunnel kiln technology appears in U.S. Pat. No. 4,235,830, car 22 in FIG. 3 of that patent being shown transporting a load of carbon articles, such as anodes, through the kiln.

Baking of carbon electrodes in the pits of ring furnaces is described, for instance in U.S. Pat. No. 3,975,149.

Another example of a patent illustrating an invention in a ring furnace context is U.S. Pat. No. 4,131,417.

Figure 1:
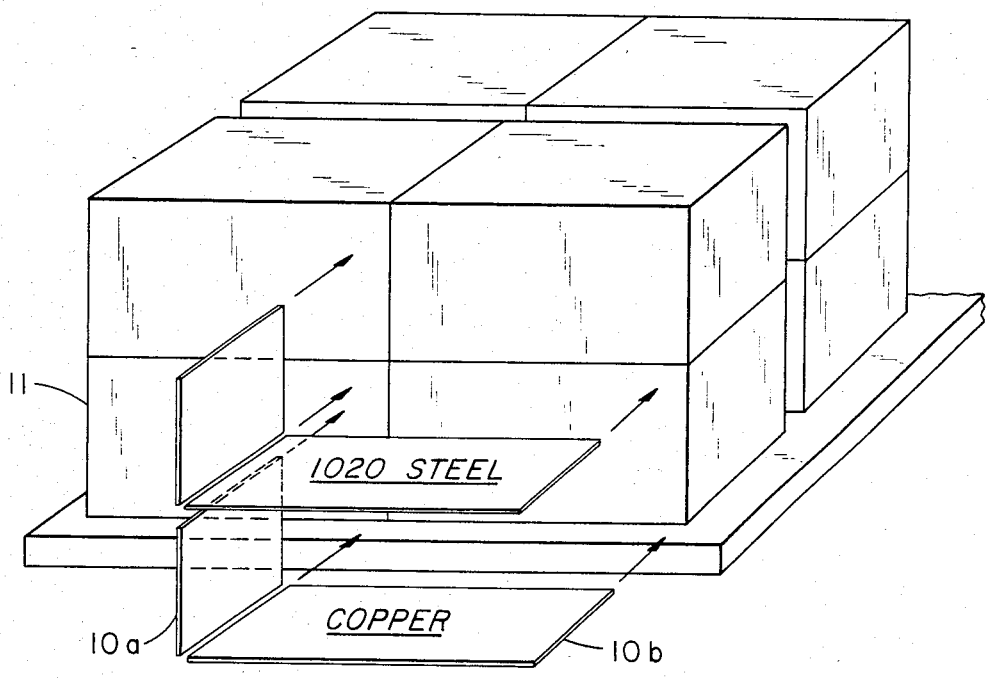
FIG. 1 is an oblique drawing of a kiln load indicating how sheet metal can be introduced for practicing the invention.

With reference to the present FIG. 1, the invention is illustrated by the distributing of material in the form of sheets into the mass of a carbon anode load. Thus, for example, sheets 10*a*, 10*b* of copper (ETP or other high purity grade) are placed between layers of anodes 11 prior to heating. Sheet 10*a* lies vertically, while sheet 10*b* lies horizontally. The sheets may be attached or loose. The sheets melt progressively when temperatures in excess of 1080° C. pass through the mass containing the sheet.

FIG. 3 in the above-referenced U.S. Pat. No. 3,009,863 is an example of how the temperature in a tunnel kiln may be controlled during anode baking. As the anode mass travels through the kiln, its temperature is cycled up and then down.

When the anode load comes out the other end of the kiln, the load is disassembled without disturbing the relationship of the sheet to remaining anodes.

Figure 2:
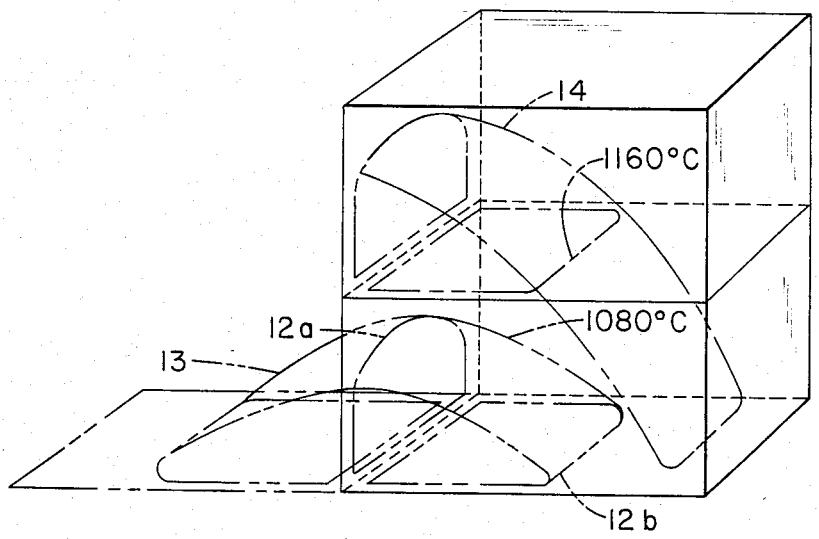
FIG. 2 is an oblique drawing illustrating isothermal surfaces determined by the invention.

After retrieval; the melt interfaces 12*a*, 12*b* are clearly visible, as shown in FIG. 2. The melt interfaces provide a fixed record of how far the isotherm corresponding to the melting point of copper penetrated into the mass represented by the anode load. This record provided by the melt interfaces permits interpolation and extrapolation of the 1080° C. isotherm in terms of isothermal surface 13. Heat is not carried any significant distance along the remaining unmelted surface of the thin copper sheet; so only a small bias is introduced by the presence of this higher thermal conductivity material in the baking mass. The negligible error is 1- or 2-inches, at most, displacement of the isothermal surface in a direction perpendicular to such surface.

In checking for the isotherm by determining the melt interfaces 12*a*, 12*b*, there are two specific cases to be considered:

1. Horizontal sheet—the larger the sheet used, in extent and thickness, the easier evaluation becomes, as the length of the interface becomes longer, allowing more points for checking, and interpolation through questionable zones. The thicker sheets show more displacement of material, so are easier to evaluate. Successful compromises of thickness versus cost are e.g. Cu sheet of 0.06 to 0.09 inch thickness for ring furnace work and 0.04 inch thickness for tunnel kiln work.

Key clues to look for:

(a) A collapsed cross section (b) Smooth surface abruptly shifting to a very unlevel surface (c) Rounding of corners and formation of meniscus surfaces (d) Impressions left by foreign debris in the areas that melted (e) Color changes In general, once a melt interface is identified in a given application, interpretation of further data is quite simple. In contrast, if for some reason, the interface is not present on the sample (sample in the wrong place; too hot or too cool), the presence of oxidation lines or other reaction artifices might be confused with the melt line. As stated before, observing a true melt line will eliminate any confusion.

2. Vertical sheet—In general, any melted metal will immediately flow away from the interface, leaving a clean break between metal being present or not, often accompanied with "wax drippings".

The 1107° C. isotherm is detected on copper sheets by a melt line of dicopper sulfide (chalcocite), a compound formed from reaction of the surface of the solid copper sheet with the sulfur indigenous to anode cokes. Since copper itself melts at 1080° C., the chalcocite melt line will be found only on the surface of horizontal copper sheet that has melted and resolidified during the heat-up, cool-down cycle of the baking process. This isotherm is not shown in FIG. 2.

The brittle nature of $Cu_2S$ is such that cracking or crumbling may make interpretation impossible. In some applications (pellets in kilns), the $Cu_2S$ reaction product can be clearly noted as a presence or lack of a pellet-shaped shell of $Cu_2S$ around a core of puddled (i.e. top surface sunken, base broadened from melting), sulfur-saturated copper.

The third isotherm, 1160° C. is detected by the limit of melting of thin-gauge, plain carbon steel sheet (ASTM 1008 to 1090). In this case, carbon reacts with solid iron, saturating the iron with carbon, generating alloy which melts at a eutectic temperature (1160° C.). This permits drawing of isothermal surface 14 in FIG. 2. This 1160° C. isotherm is less reliable as compared with the 1080° C. Cu isotherm.

Copper sheet may be replaced with coupons or pellets for repetitive checking of specific positions for control monitoring. Likewise, the steel sheet may be replaced with 4.1% carbon-iron pellets. The use of prealloyed pellets is helpful due to slow carbon diffusion rates into the heavier sections of pellets as compared to thin iron sheet.

Use of pellets is advantageous in that there is no continuous metal path, so the small bias introduced by continuous sheet is essentially eliminated, but more extrapolation and interpolation is necessary as compared to the use of sheet.

The iron and copper should not be in contact. Copper will prevent carbon from diffusing into the steel.

Also, the steel is not accurate when exposure time above 1000° C. is short (less than about ten hours), or when heatup rates are less than 25°/hour, where other iron/impurity reactions begin to dominate.

Under exposure to high sulfur cokes, the copper sheet thickness may need to be increased, such that a copper-rich solid solution with sulfur remains at the time the 1080° C. temperature is reached. A sheet converted completely to chalcocite will lose its chemical identity, as $Cu_2S+1/2S_2 \rightarrow 2CuS$. Mixtures of $Cu_2S$ and CuS then have variable melting points.

While the unique melting points presented by pure materials are of advantage, alloyed materials can also be used. Thus, eutectic compositions also give unique melting points, as do chemical compounds. Provided attention is given to the separation of the solidus from the liquidus in the case of alloys of composition other than eutectic composition, such non-eutectic alloys can be used too. For instance, the temperature difference between solidus and liquidus may be relatively small such that any error it might introduce could be negligible for determining isotherms in the baking of anodes. Even alloys which are complete solutions can be used, the precision being determined by (1) accuracy of melting point data; (2) broadness of solidus-liquidus spread; and (3) slope of solidus and liquidus lines.

As will be evident from the above discussions, isotherm recording materials in the form of alloys or compounds can either be supplied in substantially ready form, such as the 4.1% carbon-iron pellets, or they can be created in place by combining with other elements by reaction or diffusion from the mass, as takes place for pure iron, or low carbon steel, in contact with carbon anodes, or pure copper in contact with sulfur-contaminated carbon to form chalcocite.

The method of the invention has several special benefits, as compared to commonly practiced thermocouple or optical pyrometry methods of surveying anode baking temperatures. These are:

1. Temperatures may be measured at the bottom of a ring furnace pit. Previously, pit temperatures could not be measured at points located behind the hot point of a furnace operating with high baking temperatures. The themocouple well, typically a mild steel pipe through which the thermocouple would extend into the stacked anodes in the pit, would fail by melting, making deeper readings impossible. Alternately, if no well were used, the thermocouple would itself fail. In contrast the method of the invention can give data at any point from which the isotherm fixing material can be retrieved.
2. Temperatures may be measured in a moving load (tunnel kiln), thereby bypassing complicated, tedious, unreliable surveys with dragging thermocouple leads or high temperature thermocouple/radio telemetry testing.
3. The method of the invention automatically reads the peak temperature, even if the peak occurs in different spots at different times. Thermocouples require continuous reading or frequent sampling to get the same data. This is labor intensive and subject to thermocouple failure or drifting thermocouple calibrations.
4. The method of the invention, when done systematically, allows the direction of heat transmission to be determined. If a complete isotherm surface can be constructed, the surface will be normal to the heat flux at any point. This yields valuable furnace design and practice data.

It will be understood that the above description of the present invention is susceptible to various modifications, changes and adaptations and the same are intended to be comprehended within the meaning and range of equivalents of the appended claims.

What is claimed is:

1. A method of determining the penetration of an isotherm into a mass, comprising distributing material in the mass, said material having the ability to fix a record of an isotherm, cycling the temperature of the mass, and checking said material for the location of said isotherm relative to the mass, the material comprising sheet, the isotherm being indicated by a line on the sheet.

2. A method as claimed in claim 1, the material having a unique melting point.

3. A method as claimed in claim 1, the mass containing sulfur, the material comprising copper, said line being the melt line of a compound of sulfur and copper.

4. A method as claimed in claim 1, the mass containing carbon, the material comprising iron, said line being a melt interface of iron-carbon eutectic.

5. A method as claimed in claim 1, the material combining with the mass, further comprising providing sufficient material that not all the material combines with the mass during the cycling.

6. A method as claimed in claim 1, the cycling being done in a ring furnace.

7. A method as claimed in claim 1, the cycling being done in a tunnel kiln.

8. A method as claimed in claim 1, the mass comprising carbon articles.

9. A method as claimed in claim 1, the material comprising metal.

10. A method as claimed in claim 1, the ability of the material to fix said record comprising the forming of a combination product with the mass.

11. A method as claimed in claim 10, the combination product being a chemical compound.

12. A method as claimed in claim 11, the mass comprising sulfur, the material comprising copper, the compound being a copper sulfide.

13. A method as claimed in claim 12, the copper sulfide being chalcocite.

14. A method as claimed in claim 10, the combination product being about an eutectic composition.

15. A method as claimed in claim 1, the line being a melt interface of the sheet itself.

16. A method as claimed in claim 1, the line being a melt line of a coating on the sheet.

* * * * *